US006666693B2

(12) United States Patent
Belopolsky et al.

(10) Patent No.: US 6,666,693 B2
(45) Date of Patent: Dec. 23, 2003

(54) SURFACE-MOUNTED RIGHT-ANGLE ELECTRICAL CONNECTOR

(75) Inventors: Yakov Belopolsky, Harrisburg, PA (US); Wayne Arnold Zahlit, Harrisburg, PA (US)

(73) Assignee: FCI Americas Technology, Inc., Reno, NV (US)

( * ) Notice: Subject to any disclaimer, the term of this patent is extended or adjusted under 35 U.S.C. 154(b) by 35 days.

(21) Appl. No.: 09/989,646

(22) Filed: Nov. 20, 2001

(65) Prior Publication Data

US 2003/0096516 A1 May 22, 2003

(51) Int. Cl.[7] ..... H01R 12/00

(52) U.S. Cl. ..... 439/79; 439/931

(58) Field of Search ..... 439/80, 79, 676, 439/607, 83, 608, 695, 609–610, 74, 660, 931, 857, 856, 682, 284, 295, 293, 597, 567

(56) References Cited

U.S. PATENT DOCUMENTS

| | | | | |
|---|---|---|---|---|
| 3,885,076 A | | 5/1975 | Heidenreich et al. | 428/195 |
| 4,875,862 A | | 10/1989 | Sakamoto et al. | 439/79 |
| 4,882,200 A | | 11/1989 | Liu et al. | 427/53.1 |
| 4,882,633 A | | 11/1989 | Nakatani et al. | 358/339 |
| 5,577,935 A | | 11/1996 | Harting et al. | 439/581 |
| 5,688,130 A | | 11/1997 | Huang | 439/79 |
| 5,713,762 A | | 2/1998 | Mitra et al. | 439/607 |
| 5,727,956 A | | 3/1998 | Mitra et al. | 439/74 |
| 5,741,144 A | | 4/1998 | Elco et al. | 439/101 |
| 5,743,765 A | | 4/1998 | Andrews et al. | 439/608 |
| 5,766,043 A | * | 6/1998 | Talend | 439/676 |
| 5,929,516 A | | 7/1999 | Heerman et al. | 257/701 |
| 6,042,389 A | | 3/2000 | Lemke et al. | 439/74 |
| 6,083,047 A | | 7/2000 | Paagman | 439/608 |
| 6,122,172 A | | 9/2000 | Dumoulin et al. | 361/719 |
| 6,130,478 A | | 10/2000 | Dumoulin et al. | 257/728 |
| 6,183,301 B1 | | 2/2001 | Paagman | 439/608 |
| 6,241,535 B1 | | 6/2001 | Lemke et al. | 439/83 |
| 6,249,048 B1 | | 6/2001 | Heerman et al. | 257/701 |

FOREIGN PATENT DOCUMENTS

| | | |
|---|---|---|
| EP | 0 506 260 A3 | 3/1992 |
| JP | 62 063 683 A | 3/1987 |

OTHER PUBLICATIONS

U.S. patent application Ser. No. 09/989,548, Belopolsky, et al., filed Nov. 20, 2001.

* cited by examiner

*Primary Examiner*—Jean Duverne
(74) *Attorney, Agent, or Firm*—Woodcock Washburn LLP

(57) ABSTRACT

A presently-preferred electrical connector comprises an electrically insulative base member having a first surface, a substantially planar second surface, and a plurality of stud members projecting from the second surface. The base member has a plurality of through holes formed therein. The through holes each extend from the first surface to a respective stud member. At least a portion of each of the stud members is coated with an electrically conductive material. The electrical connector also comprises an electrically-insulative plate member mounted on the base member, and a conducting member. The conducting member comprises a lead portion at least partially disposed within the plate member, and a contact portion at least partially disposed within the stud member.

20 Claims, 6 Drawing Sheets

Prior Art

SURFACE-MOUNTED RIGHT-ANGLE ELECTRICAL CONNECTOR

FIELD OF THE INVENTION

The present invention relates to electrical connectors, and more particularly to surface-mounted, right-angle electrical connectors.

BACKGROUND OF THE INVENTION

FIG. 6 depicts a conventional right-angle electrical connector 100. Other examples of conventional right-angle electrical connectors can be found, for example, in U.S. Pat. Nos. 6,183,301 and 6,083,047.

The electrical connector 100 comprises a plurality of plate members 102 disposed in a side-by-side arrangement within a housing (the housing is not shown in FIG. 6, for clarity). A plurality of conducting members 120 and ground members 121 disposed within grooves formed in the plate members 102. Each conducting member 120 has a mating pin 122 and a contact portion 124 disposed at respective first and second ends thereof. Each ground member 121 includes a mating pin 126 and a contact portion 128 disposed at respective first and second ends thereof. The mating pins 122, 126 each extend away from a forward surface 102*a* of the plate member 102, in substantially the horizontal ("x") direction. The contact portions 124, 128 each extend away from a lower surface 102*b* of the plate member 102, in substantially the vertical ("y") direction.

The electrical connector 100 is adapted to be mounted on a circuit substrate such as a printed wireboard (PWB) 130. The contact portions 124, 128 are adapted to be inserted into through holes 131 in the PWB 130. The contact portions 124, 128 are then soldered to electrical traces within the PWB 130, thereby establishing electrical contact between the electrical connector 100 and the PWB 130.

The contact portions 124, 128 extend below the mounting surface on the PWB 19. Surface-mounted electrical connectors, by contrast, are typically soldered directly to electrical traces on a surface of a circuit substrate such as the PWB 19. In other words, a surface-mounted electrical connector does not extend below the mounting surface on the circuit substrate. Hence, surface-mounted electrical connectors usually require less space within an electronic device than other types of electrical connectors of similar capabilities. This feature is particularly advantageous in light of the ongoing drive to reduce the size of electronic equipment, and to add additional functions to such equipment.

Applicants have found that surface mounting, although suitable for use with right-angle connectors, has certain limitations and disadvantages when used in such applications. In particular, the forces needed to restrain right-angle connectors laterally, i.e., parallel to the mounting surface, are difficult to achieve with a surface-mount configuration. (Lateral restraint in a conventional right-angle electrical connector such as the electrical connector 100 is achieved, at least in part, by interference between the contact portions 124, 128 and the circuit substrate upon which the connector 100 is mounted.)

Lateral restraint in a surface-mounted right-angle electrical connector can be achieved by placing bumps or projections on the lower surface of one or more of the plate members thereof, and securing the bumps or projections to a mounting surface of a circuit substrate. Co-planarity among the bumps or projections on different plate members, however, is generally difficult to achieve, thus limiting the degree of lateral restraint achievable using this mounting arrangement. Furthermore, precision-placement of the electrical connector on the mounting surface is usually difficult to achieve when the connector is being fixed to the circuit substrate. Hence, surface-mounted right-angle electrical connectors are not typically configured for surface mounting.

An ongoing need therefore exists for a surface-mounted, right-angle electrical connector that can be effectively restrained in the lateral direction, and that can be precisely positioned on a mounting surface of a circuit substrate.

SUMMARY OF THE INVENTION

A presently-preferred electrical connector comprises an electrically insulative base member having a first surface, a substantially planar second surface, and a plurality of stud members projecting from the second surface. The base member has a plurality of through holes formed therein. The through holes each extend from the first surface to a respective stud member. At least a portion of each of the stud members is coated with an electrically conductive material. The electrical connector also comprises an electrically-insulative plate member mounted on the base member, and a conducting member. The conducting member comprises a lead portion at least partially disposed within the plate member, and a contact portion at least partially disposed within the stud member.

A presently-preferred right-angle electrical connector comprises a plate member having a first and a substantially perpendicular second surface, and a conducting member. The conducting member is at least partially disposed within the plate member and comprises a contact portion extending away from the second surface, and a mating pin extending away from the first surface. The electrical connector also comprises an electrically-insulative base member comprising a stud member and a main portion having a first surface and a substantially planar second surface. The first surface of the main portion is adapted to receive at least a portion of the plate member, and the stud member projects from the second surface of the main portion and is adapted to be mounted on a circuit substrate. A passage is formed within the base member and extends through the main portion and the stud member, and the conducting member is at least partially disposed within the passage. The stud member is at least partially covered with a conductive coating adapted to establish electrical contact between the contact portion and an electrical connection point on the circuit substrate.

Another presently-preferred electrical connector comprises a plurality of conducting members each comprising a contact portion and a lead portion electrically coupled to the contact portion, and a plurality of plate members disposed within the housing. Each of the plate members has a plurality of grooves formed therein for receiving the lead portions. The electrical connector also comprises a base member having a plurality of grooves formed in a first surface thereof for receiving and retaining the plate members, and a plurality of stud members projecting from a second surface thereof and being adapted to mount on a circuit substrate. The base member receives each of the contact portions in respective passages formed therein and extending through the stud members. The contact portions are adapted to be electrically coupled to the circuit substrate by a conductive coating disposed on at least a portion of each of the stud members.

Another presently-preferred electrical connector comprises a plurality of conducting members each comprising a contact portion and a lead portion electrically coupled to the contact portion. The electrical connector also comprises a plurality of electrically insulative plate members each having a first surface, a substantially perpendicular second surface, and a plurality of stud members projecting from the second surface. The stud members are at least partially covered by an electrically-conductive coating and are adapted to be mounted on a circuit substrate. The conducting members each extend between one of the first surfaces and one of the stud members. Each of the contact portions is at least partially disposed within a respective one of the stud members and is adapted to be electrically coupled to the circuit substrate by the conductive coating.

BRIEF DESCRIPTION OF THE DRAWINGS

For the purpose of illustrating the invention, the drawings show an embodiment that is presently preferred. The invention is not limited, however, to the specific instrumentalities disclosed in the drawings. In the drawings.

DESCRIPTION OF PREFERRED EMBODIMENTS

Figure 1:
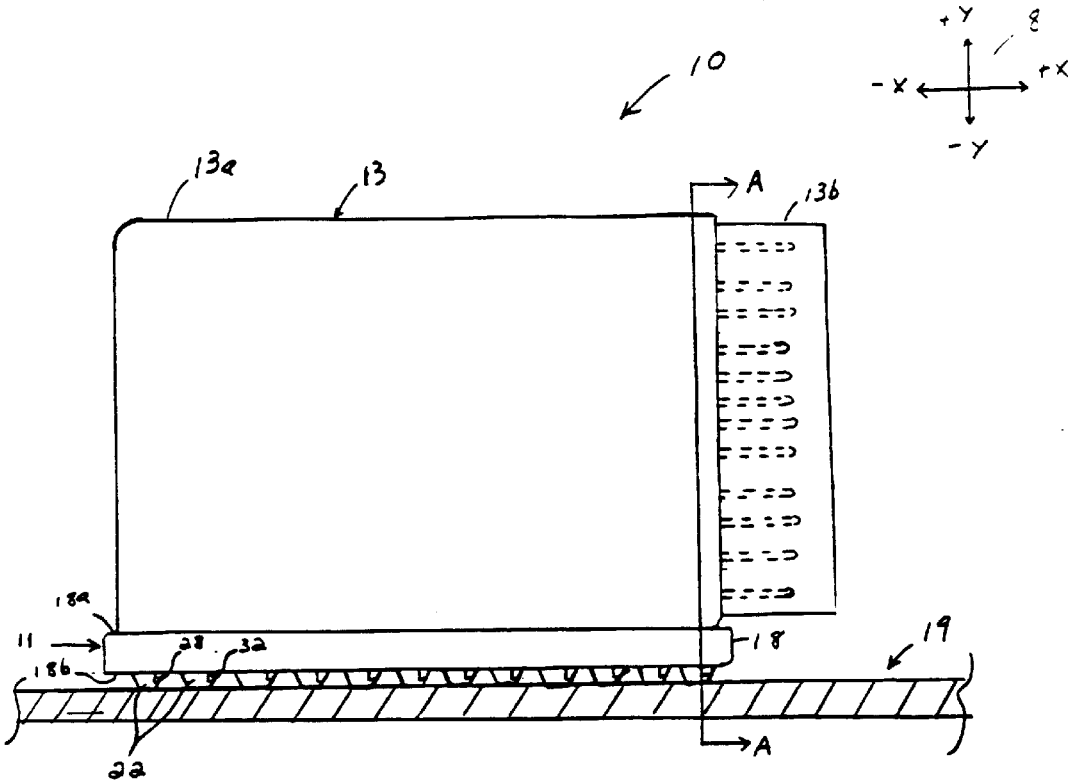
FIG. 1 is a side view of a presently-preferred right-angle electrical connector.

FIGS. 1–4 depict a presently-preferred surface-mounted right-angle electrical connector 10. Each of the figures referred to throughout the specification is referenced to a common coordinate system 8 depicted therein. The electrical connector 10 is adapted to be mounted on a circuit substrate such as a printed wireboard (PWB) 19. The electrical connector 10 adapted to mate with a second electrical connector, another circuit substrate, or a backplane (not shown). The electrical connector 10 is described in detail herein for exemplary purposes only, as the invention can be applied to virtually any type of right-angle connector. Certain features of the electrical connector 10 are also described in a co-pending application filed on Nov. 20, 2001 and titled "Pin-Grid-Array Electrical Connector," which is incorporated herein by reference in its entirety.

The electrical connector 10 comprises a base member 11, a plurality of connector modules 12, and a housing 13. The housing includes a main portion 13*a* and a forward portion 13*b* (see FIG. 1). The base member 11 is adapted to be mounted on a surface of the PWB 19, as explained in detail below. The connector modules 12 are substantially enclosed by the housing 13, and are mounted on the base member 11.

Figure 2:
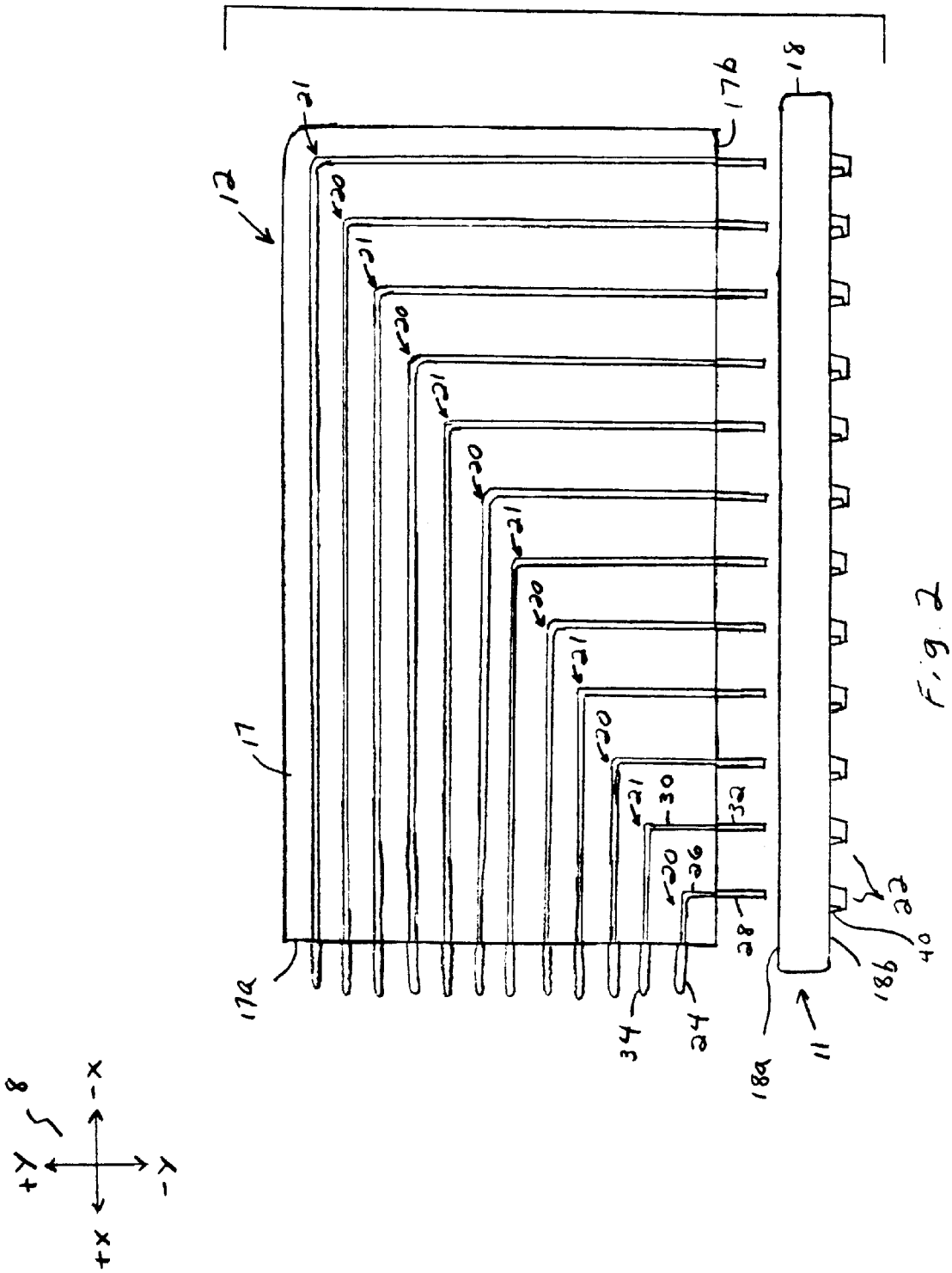
FIG. 2 is a partially-exploded side view of a connector module and a base member of the electrical connector shown in FIG. 1.

Each connector module 12 comprises a plate member 17, a plurality of signal conducting members 20, and a plurality of ground conducting members 21 (see FIG. 2). Each signal conducting member 20 comprises a mating pin 24, a lead portion 26, and a contact portion 28. A first end of the lead portion 26 is mechanically and electrically coupled to the contact portion 28, and an opposing second end of the lead portion 26 is mechanically and electrically coupled to the mating pin 24. This arrangement forms an electrical path between the mating pin 24 and the contact portion 28.

Each of the contact portions 28 preferably has a substantially rectangular cross-section. The lead portions 26 each include one or more bends that cause the mating pin 24 and the contact portion 28 to extend in substantially perpendicular directions, i.e., the mating pin 24 extends substantially in the "x" direction, and the contact portion 28 extends substantially in the "y" direction (see FIG. 2).

Each ground conducting member 21 comprises a lead portion 30 (see FIG. 2). A first end of each lead portion 30 is mechanically and electrically coupled to a contact portion 32. An opposing second end of each lead portion 30 is mechanically coupled to a mating pin 34. This arrangement electrically couples the contact portion 32 and the mating pin 34. Each of the contact portions 32 preferably has a substantially rectangular cross-section (other cross-sectional shapes, e.g., circular or conical, can also be used). The lead portions 30 each include one or more bends that cause the mating pins 34 and the contact portions 32 to extend in substantially perpendicular directions, i.e., the mating pins 34 extend substantially in the "x" direction, and the contact portions 32 extend substantially in the "y" direction."

Each plate member 17 is formed from an electrically insulative material such as plastic. The plate members 17 each have a substantially planar forward surface 17*a* and a substantially planar lower surface 17*b* (see FIG. 2). The forward surface 17*a* and the lower surface 17*b* are substantially perpendicular. The plate member 17 has a plurality of grooves 35 formed therein (see FIG. 3; the grooves 35 are not depicted in FIG. 2, for clarity). The grooves 35 extend between the forward surface 17*a* and the lower surface 17*b*, and receive the respective lead portions 26, 30 of the conducting members 20 and the ground members 30. This arrangement causes the mating pins 24, 34 to extend away from the forward surface 17*a* of the plate member 17; the contact portions 28, 32 likewise extend away from the lower surface 17*b* of the plate member 17. Alternative embodiments of the plate members 17 may accommodate more or less than the six conducting members 20 and six ground conducting members 21 positioned within each plate member 17.

It should be noted that directional terms such as "upper," "lower," etc., are used with reference to the component orientations depicted in FIGS. 1–4; these terms are used for illustrative purposes only and, unless expressly stated otherwise, are not intended to limit the scope of the appended claims.

The exemplary electrical connector 10 includes six of the connector modules 12 disposed in a side-by-side arrangement within the housing 13. In other words, the connector modules 12 are positioned so that the forward surfaces 17*a* of the plate members 17 are substantially co-planar, and the lower surfaces 17*b* of the plate members 17 are also substantially co-planar. The contact portions 32, 26 each extend below the main portion 13*a* of the housing 13. The significance of this feature is discussed below.

The forward portion 13*b* of the housing 13 encloses the mating pins 24, 34 (see FIG. 1). The mating pins 24, 34 are each adapted to engage a respective a female receptacle on another connector, a circuit substrate (other than the PWB 19), or a backplane.

The connector modules 12 are mechanically and electrically coupled to the PWB 19 by way of the base member 11.

The base member 11 comprises a main portion 18. The main portion 18 has an upper surface 18*a* that partially receives the plate members 17, and a substantially planar second surface 18*b*. The base member 11 further comprises a plurality of stud members 22 projecting from the second surface 18*b*. The stud members 22 and the main portion 18 are formed from an insulative material such a plastic, and most preferably are formed from liquid crystal polymer (LCP). The stud members 22 and the main portion 18 are preferably formed on a unitary basis. Each stud member 22 has an inner, or recessed surface portion 22*a* that defines a recess 40 (see FIGS. 3 and 4). The significance of this feature is explained below.

Figure 3:
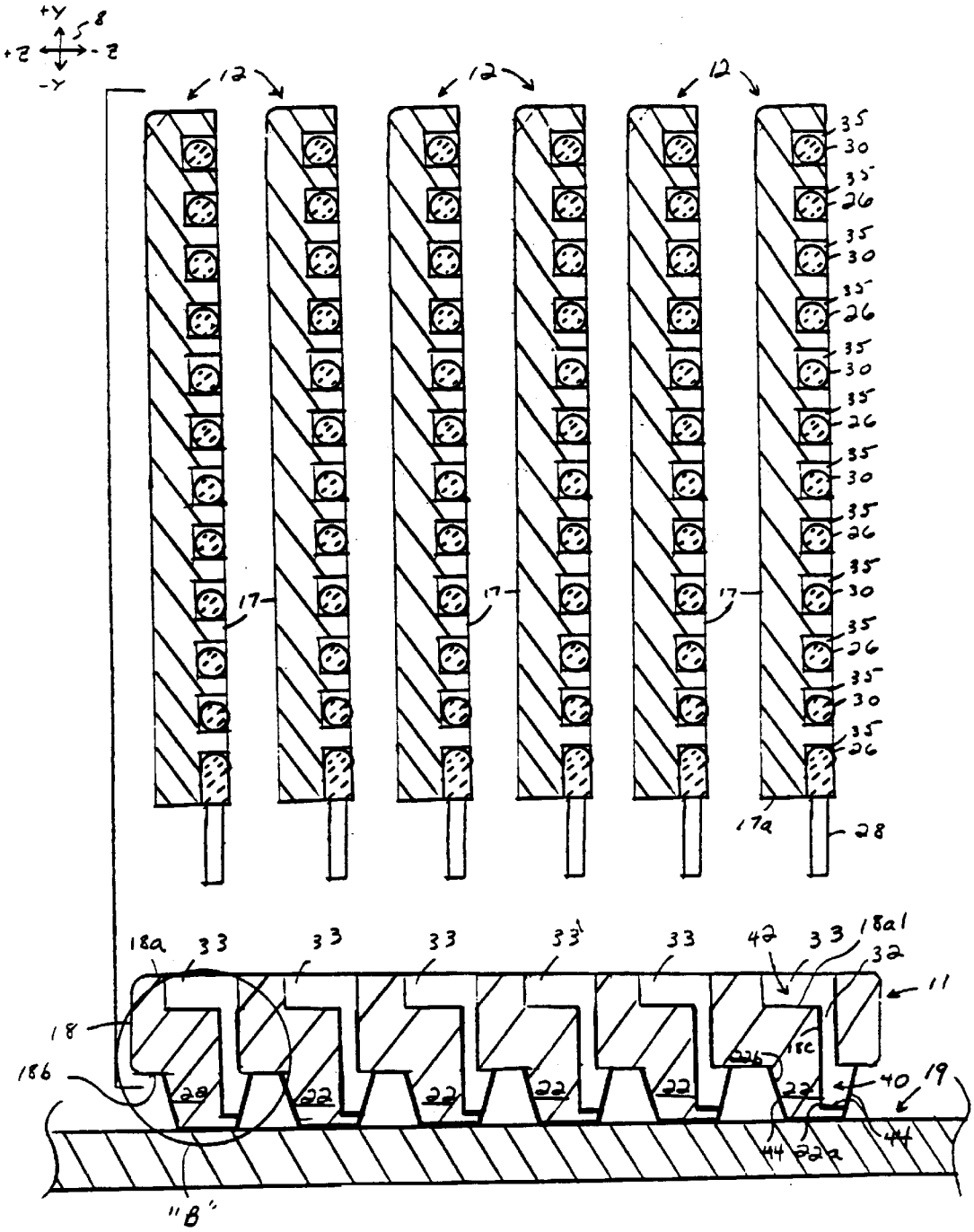
FIG. 3 is a partially-exploded front view of the connector module and base member shown in FIG. 2, taken through the line "A—A" of FIG. 1.

The upper surface 18*a* of the base member 18 defines a plurality of slots 33 (see FIG. 3). The slots 33 each extend substantially in the longitudinal ("x") direction, along substantially an entire length of the base member 18. A bottom of each slot 33 is defined by a surface portion 18*a*1 of the upper surface 18*a*

Each of the slots 33 is sized to partially receive a respective one of the plate members 17. In particular, each of the slots 33 has a width ("z" dimension) and a length ("x" dimension) approximately equal to a respective width and length of each plate member 17. Each slot 33 is thus adapted to receive and securely engage a bottom portion of a respective plate member 17 by way of a press fit. In other words, a bottom portion of each plate member 17 is pressed into a respective one of the slots 33 so that the bottom surface 17*b* of the plate member 17 abuts the surface portion 18*a*1 of the base member 11, thereby securing the plate member 17 to the base member 11. (Other suitable means of securing the plate members 17 to the base member 11 can be used instead of a press fit.)

A plurality of through holes 32 are formed in the base member 11 (see FIG. 3). Each through hole 32 is defined by a respective surface portion 18*c* in the main portion 18.

The through holes 32 each extend from the surface portion 18*a*1 to a respective stud member 22. Each through hole 32 adjoins a respective recess 40. Each corresponding through hole 32 and recess 40 form a passage 42 that extends through the main portion 18 and the respective stud member 22. The passage 42 is adapted to receive at least a portion of a contact portion 32, 26. In other words, the contact portions 32, 36 are each substantially aligned with, and extend into a respective passage 42 when the plate members 17 are positioned on the base member 11. Further details concerning the passages 42 are presented below.

The surface portions 18*c* and the stud members 22 are at least partially covered with a conductive coating 44. (The thickness of the conductive coating is exaggerated in the figures, for clarity.) The conductive coating 44 is a metallized layer that establishes electrical contact between the contact portions 32, 36 and the PWB 19, as explained in detail below. The coating 44 is preferably formed from copper (Cu), nickel (Ni), and tin (Sn). The coating 44 is applied by activating the second surface 18*b* of the main portion 18 and a lower end of the surface portion 18*c* with electroless CU. The recessed surface portion 22*a* of the stud member 22 are also activated with the electroless CU. A 20–25-micron layer of electrolytic CU, a 4–6-micron layer of electrolytic Ni, and a 4-6 micron layer of electrolytic Sn are then sequentially applied to the activated areas.

A substantial portion of the Sn layer located on the second surface 17*b* is subsequently removed by laser oblation, and the underling layers of Cu and Ni are removed by chemical etching. The coating 44 that remains after this process forms a substantially contiguous metallized layer on and immediately surrounding each stud member 22. In particular, the coating 44 associated with each stud member 22 covers an outer surface 22*b* and the recessed surface portion 22*a* of the stud member 22, a portion of the second surface 18*b* immediately adjacent the outer surface 22*b*, and the lower end of each surface portion 18*c*.

It should be noted that specific details relating to the composition and application of the coating 44 are presented for exemplary purposes only; the coating 44 can be formed from virtually any type of suitable conductive material applied in any conventional manner.

The passages 42 are each adapted to receive at least a portion of one of the contact portions 32, 36, as noted above. A minimal clearance, e.g., 0.001 inch, preferably exists between each signal or contact portion 32, 36 and the coating 44 when the contact portions 32, 36 are positioned within the passages 42.

Figure 4:
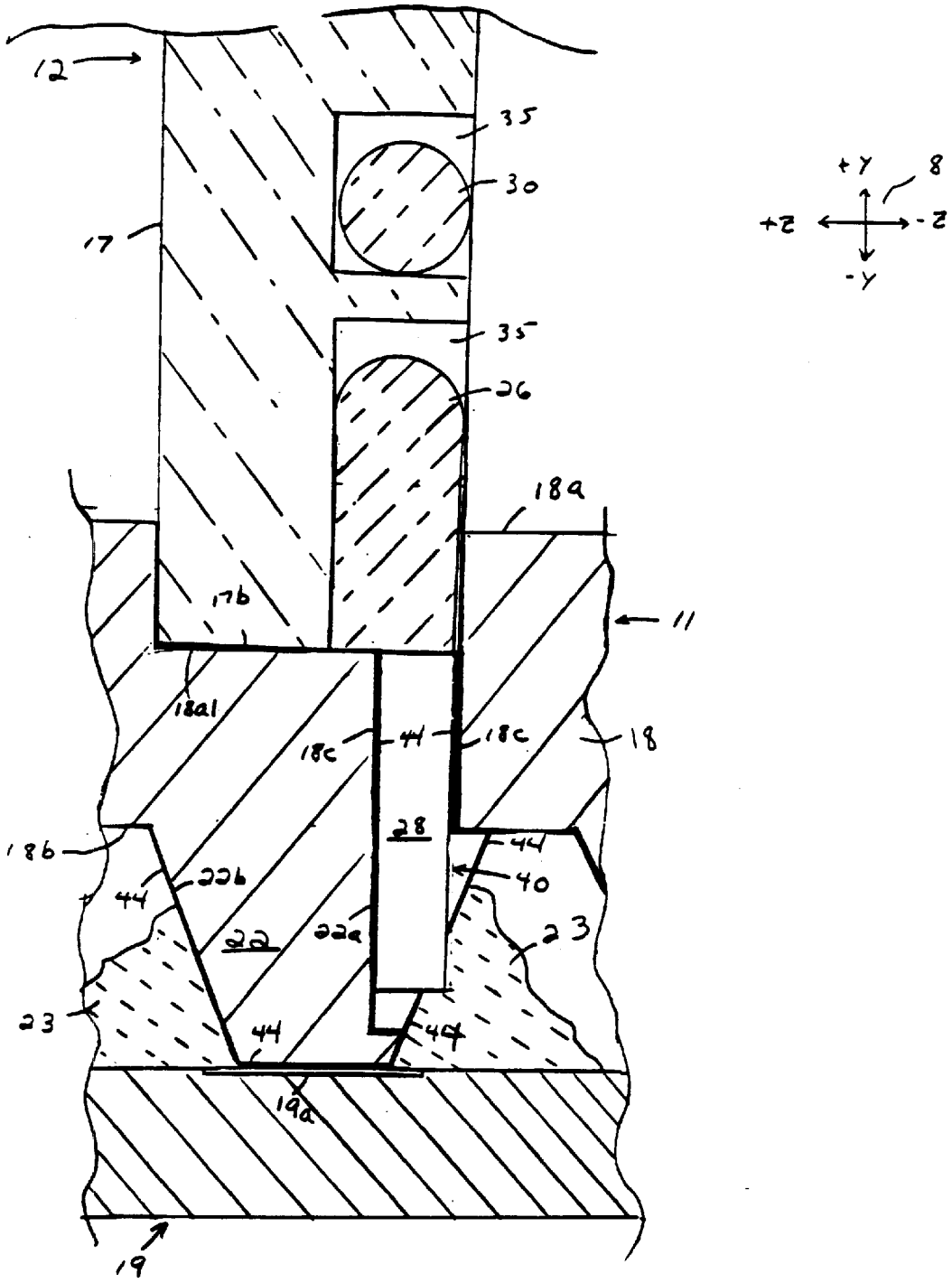
FIG. 4 is a magnified view of the area designated "B" in FIG. 3, with the connector module and the base member shown in FIGS. 2 and 3 in an assembled state.

The PWB 19 includes a plurality of electrical traces that each terminate in a respective electrical connection point 19*a* (see FIG. 4). The electrical connector 10 is mechanically and electrically coupled to the PWB 19 by a mass soldering process, e.g., wave soldering, that forms a solder joint 23 between each stud member 22 and a corresponding electrical connection point 19*a* (see FIG. 4; the solder joints 23 are not depicted in FIG. 1 or 3, for clarity).

The base member 11 preferably includes at least one stud-member support 22*c*. The stud-member support 22*c* does not have a signal or contact portion 32, 36 disposed therein.

The stud-member support 22*c* functions a guide for precisely positioning the electrical connector 10 on the PWB 19 as the electrical connector 10 is secured to the PWB 19.

The mechanical and electrical connections between the electrical connector 10 and the PWB 19 are facilitated by the conductive coating 44. More specifically, the solder joints 23 securely bond the electrical connection points 19*a* to the conductive coating 44 on the respective stud members 22, thereby securing the electrical connector 10 to the PWB 19.

Furthermore, the conductive coating 44, in conjunction with the solder joints 23, forms an electrically-conductive path between the electrical connection points 19*a* and the respective contact portions 28, 32.

The electrical connector 10 provides substantial advantages in relation to conventional surface-mounted right-angle connectors. For example, the electrical connector 10 provides the advantages of surface-mounted connectors, e.g., compact size, while avoiding the difficulties usually associated with precisely positioning such connectors on a mounting surface. In particular, the stud-member supports 22*c* permit the electrical connector 10 to be precisely aligned with a predetermined position on the PWB 19 when the electrical connector 10 is installed on the PWB 19. This feature facilitates optimal electrical contact between the electrical connection points 19*a* on the PWB 19, and the respective conducting members 20, 21 of the electrical connector 10. In addition, forming the stud members 22 as part of a unitary base member 11 facilitates a relatively high degree of co-planarity among the stud members 22, further optimizing the electrical contact between the electrical connection points 19*a* and the conducting members 20, 21.

It is to be understood that even though numerous characteristics and advantages of the present invention have been set forth in the foregoing description, together with details of the structure and function of the invention, the disclosure is illustrative only, and changes may be made in detail, especially in matters of shape, size, and arrangement of the parts, within the principles of the invention to the full extent indicated by the broad general meaning of the terms in which the appended claims are expressed. For example, alternative configurations for the stud members 22 are set forth in the co-pending application filed on Nov. 20, 2001 and titled "Pin-Grid-Array Electrical Connector" which, as previously noted, is incorporated herein by reference in its entirety. Furthermore, the mating pins 24, 34 of the electrical connector 10 can be replaced with female receptacles, i.e., the electrical connector 10 can be adapted to mate with a complementary pin connector.

Figure 5:
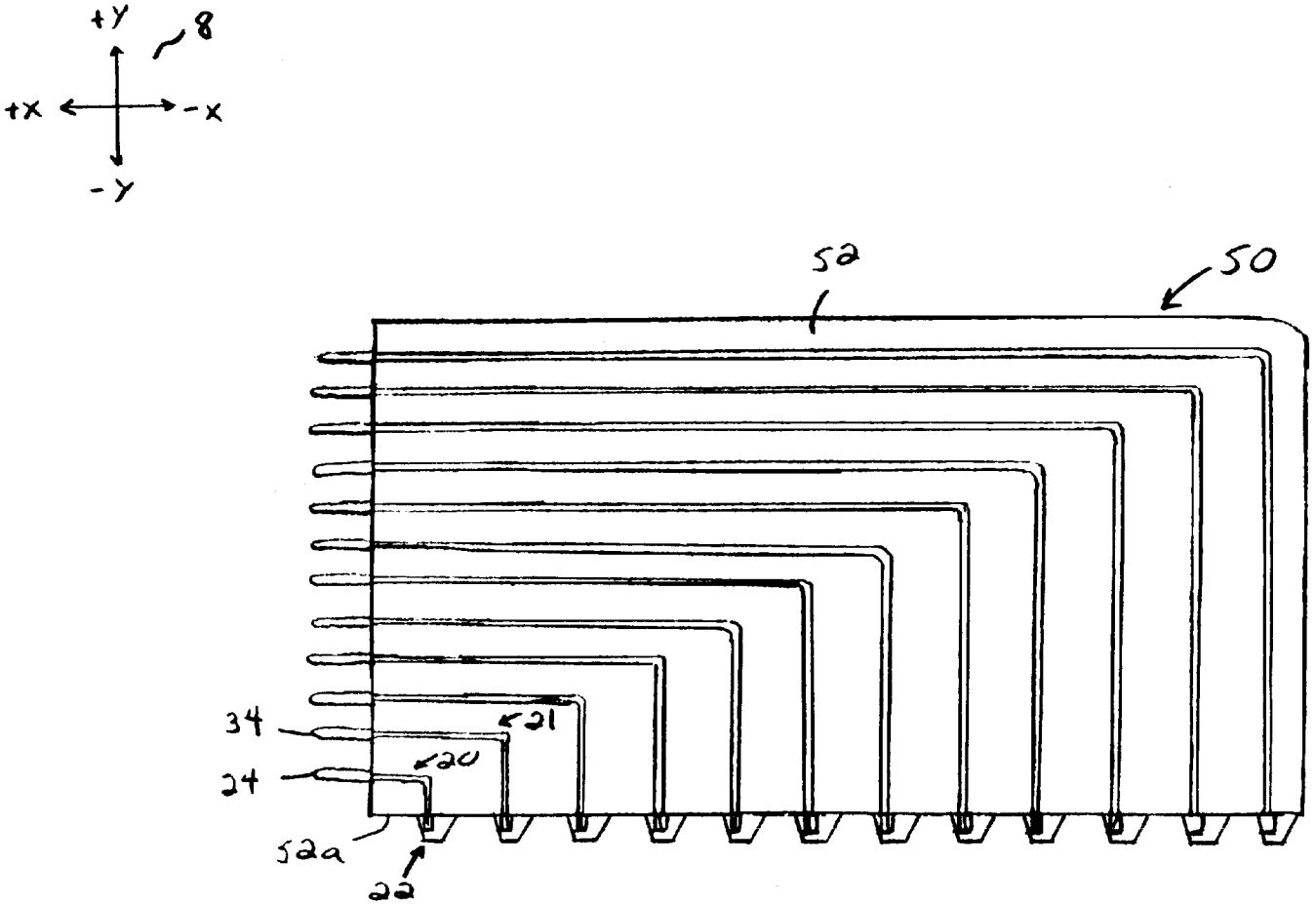
FIG. 5 is a side view of an alternative embodiment of the connector module shown in FIG. 2.
Figure 6:
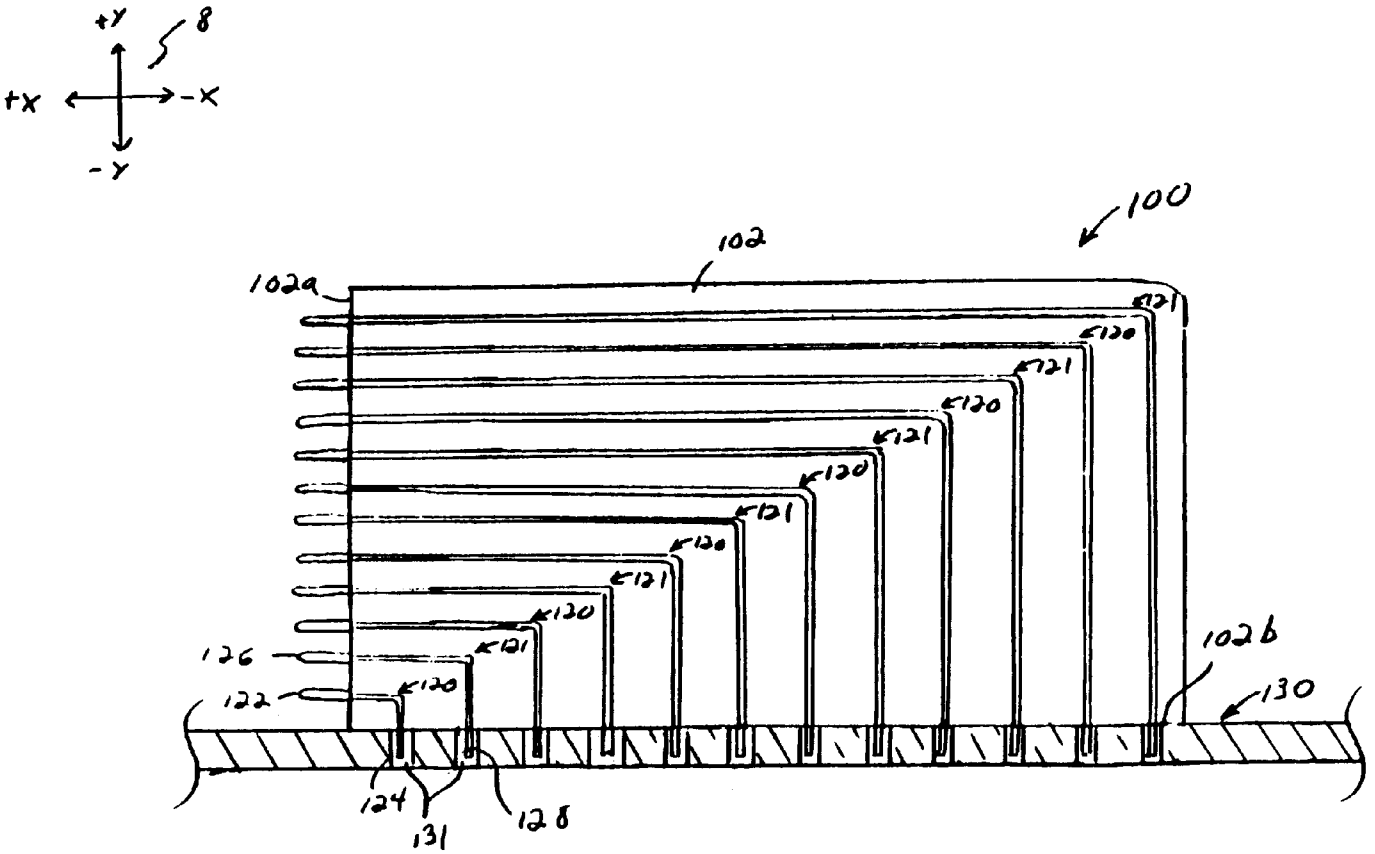
FIG. 6 is a side view of a conventional right-angle electrical connector.

FIG. 5 depicts connector module 50. The connector module 50 represents an alternative embodiment of the connector module 12. Components of the connector module 50 that are substantially identical to those of the connector module 12 are denoted by common reference numerals. The connector module 50 comprises a plate member 52 having stud members 22 formed on a lower surface 52*a* thereof. The connector module 52 is thus adapted to mount directly on a circuit substrate such as the PWB 19. In other words, the connector module 50 mounts on the PWB 19 without the use of a base member such as the base member 11 of the electrical connector 10.

What is claimed is:

1. An electrical connector, comprising:

electrically insulative base member having a first surface, a substantially planar second surface, and a plurality of stud members projecting from the second surface for mounting the base member on a circuit substrate, the base member having a plurality of through holes formed therein, the through holes each extending from the first surface to a respective stud member, at least a portion of each of the stud members being coated with an electrically conductive material for electrically contacting a respective electrical contact point on the circuit substrate;

an electrically-insulative plate member mounted on the base member; and a conducting member comprising a lead portion at least partially disposed within the plate member and a contact portion at least partially disposed within the stud member.

2. The electrical connector of claim 1, wherein the stud member has an outer surface and an inner surface, the inner surface defining a recess that adjoins the first through hole and is adapted to at least partially receive the contact portion, wherein at least a portion of the outer and the inner surfaces are coated with a substantially contiguous layer of the electrically conductive material.

3. The electrical connector of claim 1, wherein the first surface of the base member defines a groove for receiving a portion of the plate member.

4. The electrical connector of claim 1, wherein the conducting member further comprises a mating pin mechanically and electrically coupled to the lead portion.

5. The electrical connector of claim 1, wherein the contact portion has a substantially rectangular cross section.

6. The electrical connector of claim 1, wherein the base member further comprises a main portion unitarily formed with the stud members.

7. The electrical connector of claim 4, wherein the mating pin and the contact portion extend in substantially perpendicular directions.

8. The electrical connector of claim 1, wherein the conductive coating is disposed within at least a portion of the through hole.

9. The electrical connector of claim 1, wherein the base member is formed from liquid crystal polymer.

10. The electrical connector of claim 1, wherein an outer surface of the stud member is coated with the electrically conductive material.

11. The electrical connector of claim 1, wherein the conductive coating comprises copper, nickel, and tin.

12. The electrical connector of claim 11, wherein the conductive coating comprises a layer of the copper approximately twenty to approximately twenty-five microns thick, a layer of the nickel approximately four to approximately six microns thick, and a layer of the tin approximately four to approximately six microns thick.

13. The electrical connector of claim 1, wherein the base member further comprises a stud-member support projecting from the second surface.

14. The electrical connector of claim 1, further comprising a housing, wherein the plate member is at least partially disposed within the housing.

15. The electrical connector of claim 1, wherein the housing comprises a main portion and a forward portion.

16. The electrical connector of claim 1, wherein the plate has a plurality of grooves formed therein for receiving the lead portion of the conducting member.

17. A right-angle electrical connector, comprising:

a plate member having a first and a substantially perpendicular second surface;

a conducting member at least partially disposed within the plate member and comprising a contact portion extending away from the second surface and a mating pin extending away from the first surface;

an electrically-insulative base member comprising a stud member and a main portion having a first surface and a substantially planar second surface, wherein the first surface of the main portion is adapted to receive at least a portion of the plate member, the stud member projects from the second surface of the main portion and is adapted to be mounted on a circuit substrate, a passage is formed within the base member and extends through the main portion and the stud member, the conducting member is at least partially disposed within the passage, and the stud member is at least partially covered with a conductive coating adapted to establish electrical contact between the contact portion and an electrical connection point on the circuit substrate.

18. An electrical connector, comprising:

a plurality of conducting members each comprising a contact portion and a lead portion electrically coupled to the contact portion;

a plurality of plate members disposed within the housing, each of the plate members having a plurality of grooves formed therein for receiving the lead portions; and a base member having (i) a plurality of grooves formed in a first surface thereof for receiving and retaining the plate members and (ii) a plurality of stud members projecting from a second surface thereof and being adapted to mount on a circuit substrate, wherein the base member receives each of the contact portions in respective passages formed therein and extending through the stud members, and the contact portions are adapted to be electrically coupled to the circuit substrate by a conductive coating disposed on at least a portion of each of the stud members.

19. The electrical connector of claim 18, wherein the plurality of conducting members comprises at least one of a signal conducting member and at least one of a ground conducting member.

20. An electrical connector, comprising:

a plurality of conducting members each comprising a contact portion and a lead portion electrically coupled to the contact portion;

a plurality of electrically insulative plate members each having a first surface, a substantially perpendicular second surface, and a plurality of stud members projecting from the second surface, wherein the stud members are at least partially covered by an electrically-conductive coating and are adapted to be mounted on a circuit substrate, the conducting members each extend between one of the first surfaces and one of the stud members, and each of the contact portions is at least partially disposed within a respective one of the stud members and is adapted to be electrically coupled to the circuit substrate by the conductive coating.

* * * * *